US005502853A

United States Patent [19]

Singleton et al.

[11] Patent Number: 5,502,853

[45] Date of Patent: Apr. 2, 1996

[54] BED FRAME WITH INDEPENDENTLY OSCILLATING CRADLE

[75] Inventors: William H. Singleton, Evergreen; Robert J. Dorman, Lakewood, both of Colo.

[73] Assignee: Sequin Hospital Bed Corp., Lakewood, Colo.

[21] Appl. No.: 195,290

[22] Filed: Feb. 14, 1994

[51] Int. Cl.[6] ..... A47B 7/00; A47C 19/04

[52] U.S. Cl. ..... 5/609; 5/617; 5/430; 5/185; 5/510; 5/608

[58] Field of Search ..... 5/609, 608, 607, 5/610, 611, 613, 617, 424, 425, 184, 185, 510, 430

[56] References Cited

U.S. PATENT DOCUMENTS

| | | | |
|---|---|---|---|
| 728,865 | 5/1903 | Cheethan | 5/607 |
| 1,644,043 | 10/1927 | Tiedemann | 5/608 |
| 2,522,018 | 9/1950 | Blackman | 5/607 |
| 3,585,660 | 6/1971 | Gottfried | 5/185 |
| 4,175,550 | 3/1979 | Leininger | 5/607 |
| 4,210,341 | 7/1980 | Minkoff | 5/510 |
| 4,432,353 | 2/1984 | Vrzalik | 5/607 |
| 4,535,762 | 8/1985 | Natcher | 5/608 |
| 4,669,136 | 6/1987 | Waters | 5/607 |
| 4,751,755 | 6/1988 | Carey | 5/614 |

FOREIGN PATENT DOCUMENTS

| | | | |
|---|---|---|---|
| 600869 | 6/1978 | Switzerland | 5/620 |
| 1554107 | 10/1979 | United Kingdom | 5/609 |

*Primary Examiner*—Flemming Saether
*Attorney, Agent, or Firm*—Edwin H. Crabtree; Donald W. Margolis; Ramon L. Pizavro

[57] ABSTRACT

An oscillatory bed for providing improved patient care in a hospital, nursing home or home health care setting. The oscillatory bed is characterized by having hinged, adjustable side panels along opposite sides of the length of a cradle located in the oscillating bed, which can be raised from a flattened position to form a "U" shaped cradle configuration during the operation of the bed. The adjustable side panels can be quickly lowered to the flattened position for emergency treatment of the patient or in changing of the bed. The oscillatory bed also includes a linear actuator in a head board section and in a foot board section. By raising the head board section, the patient's head and upper body are raised above the patient's feet. Also, the foot board section can be raised, and in turn the patient's feet are raised above the patient's head and upper body. The cradle of the oscillatory bed is further characterized by having a cradle base which has two components; an upper cradle portion with cradle head panel and a lower cradle portion. The cradle head panel is attached to a linear actuator which raises the cradle head panel and in turn allows the patient's upper body and head to be raised up to 30 degrees above a plane of the cradle base. The oscillatory bed further includes electronic microprocessor controls that allow continuous oscillations of the cradle with cycle times between 30 to 240 minutes or the oscillations can be programmed to stop at three locations for interval periods of 5 to 120 minutes before resuming the oscillations. The interval stops can occur when the bed is in a horizontal position, in a raised left side position and a raised right side position.

17 Claims, 9 Drawing Sheets

BED FRAME WITH INDEPENDENTLY OSCILLATING CRADLE

BACKGROUND OF THE INVENTION (a) Field of the Invention

This invention relates to beds, but more specifically to patient and convalescent beds for the care of persons who have restricted mobility, have limited abilities of movement, have pulmonary complications, and more particularly, but not by way of limitation, to patient convalescent beds which oscillate on a longitudinal axis.

Heretofore, the need for an improved patient care apparatus, in particular in the form of a convalescent bed which helps alleviate various physical and medical problems associated with persons who are confined to bed for extended periods, has long been recognized. The difficulties and secondary trauma resulting from such confinement are well documented. Many problems arise when a person's body remains in a prone position without movement for extended periods of time. For example, restricted movement of the body can cause blood pooling in the lower portions of the body, resulting in the risk of life threatening clots. The patient may also experience a higher risk of pneumonia, or other respiratory infections, induced by the stagnation of the bodily fluids caused by the lack of motion.

Persons confined to bed for prolonged periods with restricted movement will also experience atrophied muscle tissue. Another significant side effect, while less life threatening, is the formation of decubitus ulcers (pressure sores) on the prominences of the body which come in direct and continuous contact with the bed. These unpleasant, large and very painful sores can form in a matter of hours if the patient is not moved on a regular basis and pose a serious health problem.

It has long been recognized by medical personnel that regular turning of the body, so that its weight rests on different longitudinal sectors (i.e. the left side, the back and the right side), will significantly reduce or prevent the negative effects of continuous, localized pressure and positioning on the body caused by being confined to bed. Manual turning, while effective, is at best cumbersome and, since patients usually can not assist in the turning, often causes injury to those performing the turning. Manual turning is very labor intensive, and in a hospital or nursing home setting may not always be accomplished at the necessary intervals. In the home care setting, manual turning requires the almost continuous presence of family or health care personnel, increasing both time and financial burdens.

(b) Description of the Prior Art

Heretofore there have been a variety of oscillatory patient beds, cradle bed frames, rocking bed structures and the like which are discussed in detail in U.S. Pat. No. 5,103,511 to Sequin. The patents mentioned in the Sequin patent are incorporated herein by reference. None of the prior art patents discussed in the Sequin patent (U.S. Pat. No. 5,103,511), disclose or teach the unique features and combination of structure with added advantages for improved patient care as compared to the subject oscillatory bed described herein.

SUMMARY OF THE INVENTION

An object of the present invention is to provide an oscillatory bed having hinged, adjustable side panels along opposite sides of the length of a cradle contained in the oscillatory bed which can be raised from a flattened position to form a "U" shaped cradle configuration during the operation of the bed. The adjustable cradle configuration prevents the patient from sliding and reduces shear, which can lead to the breakdown of the skin (dermis), during the oscillation. Each side panel can independently swing a total of 85 degrees from a horizontal position to an almost upright position and is infinitely adjustable to any position within this range. The adjustable side panels can be quickly lowered to a flattened position for emergency treatment of a patient, such as CPR, or for ease in the changing of bed linens, cleaning the patient, etc.

Another object of the oscillatory bed is that the head board section and foot board section of the bed include a linear actuator for raising and lowering of the head and of the foot of the bed. By raising the head board section, the patient's head and upper body are raised above the height of the patient's feet in a Trendelenburg position. By raising the foot board section, the patient's feet are raised above the head of the patient into a Reverse Trendelenburg position. The Trendelenburg positions are required in many medical treatment situations. Also, it has been found that prior art hospital and nursing home beds are to high in a normal operating position for invalid patients to easily enter or exit the bed. The subject bed can easily be lowered in height for easy access by the patient by lowering both the head and foot board sections simultaneously.

Still another feature of the invention is a cradle base that is divided wherein a cradle head panel of the base can be raised by a linear actuator up to 30 degrees above the horizontal plane of the cradle base. This is called a semi-Fowlers position. In many medical treatments, and for the patients comfort, the raising of a patient's head and upper torso is desired and is now provided by the subject bed.

Yet another feature of the oscillatory bed are electronic controls that allow two oscillating cradle options: (1) continuous oscillation with cycle times between 30 to 240 minutes or (2) oscillation that can be programmed to stop for interval periods of 5 to 120 minutes before resuming the oscillation. The interval stops occur when the cradle base is in a horizontal position and in a raised left or right side position. It has been found beneficial in many cases, to be able to stop the bed's oscillation at programmed intervals and at the designated stops rather than operate in continuous oscillation.

A safety feature, stopping of the oscillatory bed, is provided by pressure sensors mounted on the side panels of the cradle. Should the cradle encounter an obstruction during an oscillation cycle, the cradle will automatically stop oscillating and audio and visual alarms will be initiated.

Still another object of the invention is the ability of the entire bed to be lowered to its lowest position, a transport dolly attached to the same side of both end sections and the entire assembly rotated 90 degrees onto the transport dollies. With the removal of the adjustable support assemblies, the bed's "width" is reduced to 30 inches. In this configuration, the bed can easily be moved through a standard 32 inch doorway without further disassembly.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENT

Figure 1:
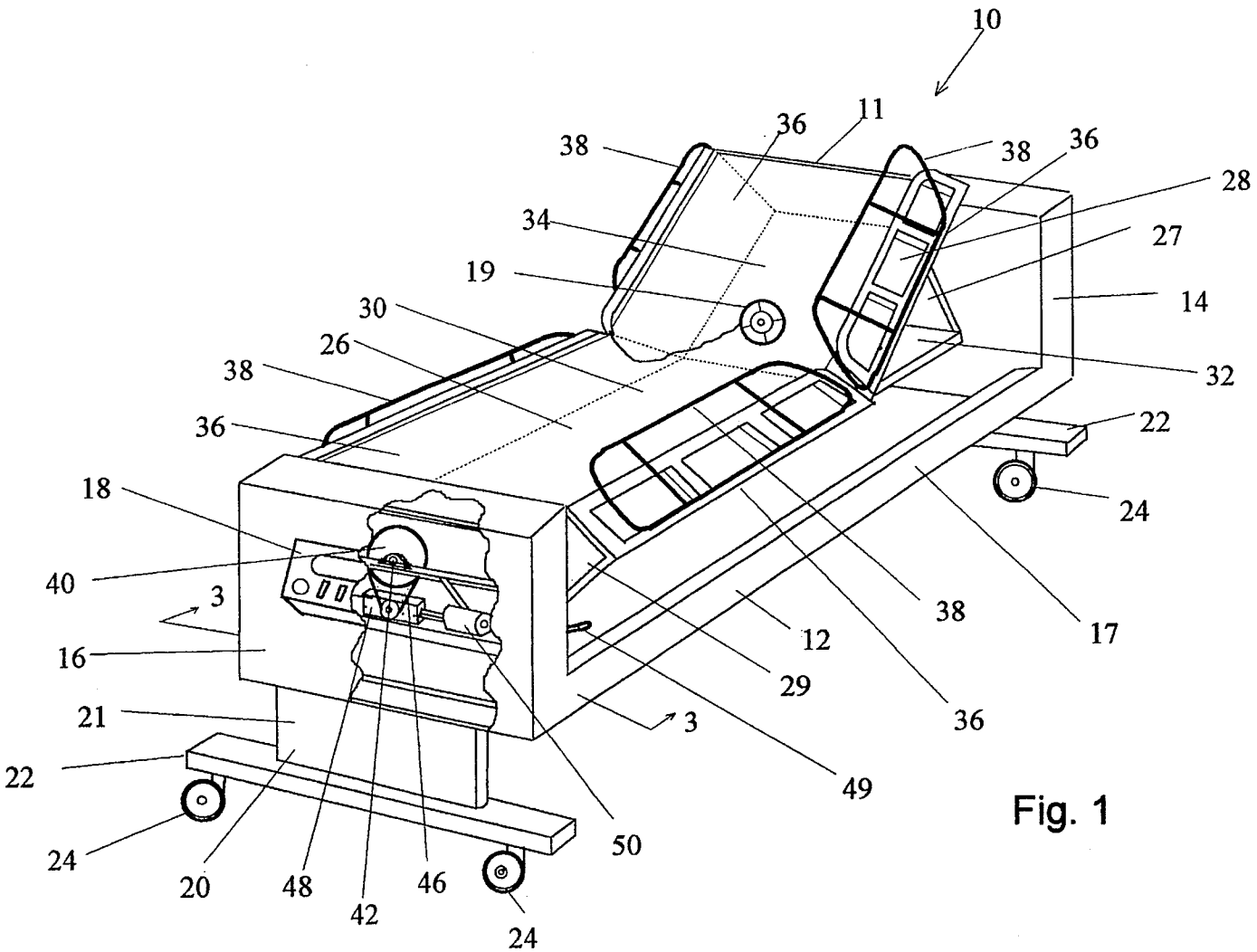
FIG. 1 illustrates a perspective view of the subject oscillatory bed with a upper cradle portion shown in a raised, semi-Fowlers position and a portion of a foot board section cut away to expose a motor and gear assembly used for oscillating the bed.

In FIG. 1 a perspective view of the oscillatory bed is shown as having general reference numeral 10. The bed 10 includes a cradle 11 received inside a unitized frame 12. The frame 12 includes a head board section 14, a foot board section 16, and two longitudinal members 17 joining the two sections 14 and 16. A control panel 18 is mounted on the foot board section 16 for controlling the operation of the bed. Also shown in this drawing is a remote control 19 for patient use in raising and lowering an upper body and head portion of the bed 10. Disposed below the head board section 14 and foot board section 16 are adjustable support assemblies 20 attached to the head and foot board sections 14 and 16 and mounted on caster wheel assemblies 22 having caster wheels 24. The adjustable support assemblies 20 include a cover 21 therearound.

Figure 3:
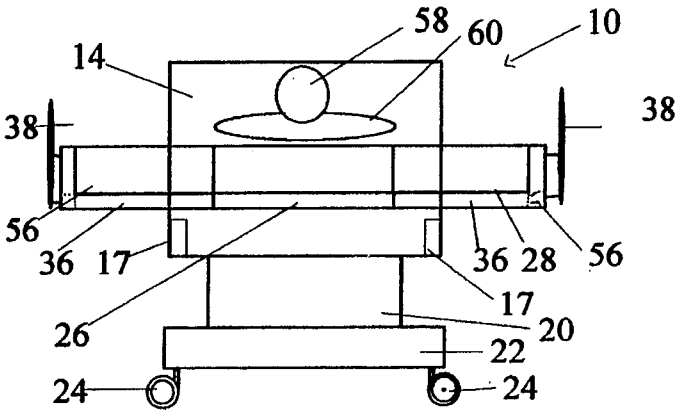
Figure 13:
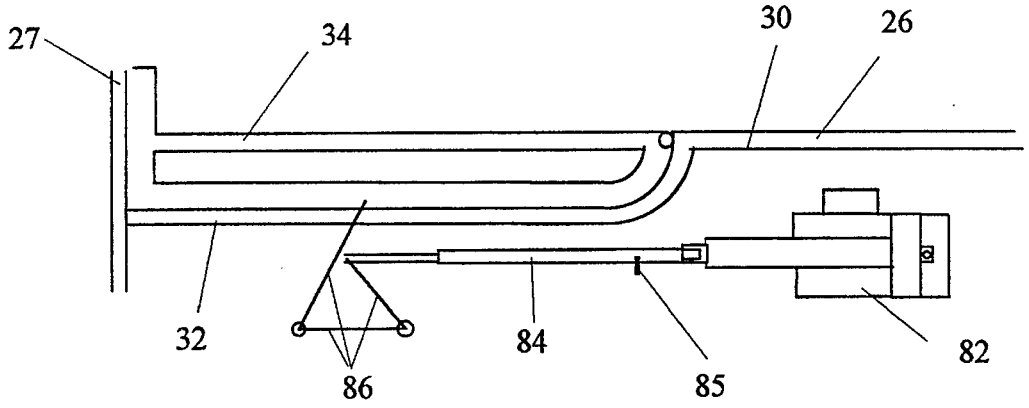
FIGS. 13 and 14 show a side view of the cradle base with the upper body panel in a lowered horizontal position (FIG. 13), and in a raised position (FIG. 14). These figures portray the semi-Fowlers (raised) position and how the patient's head and upper body can be raised up to 30 degrees from the horizontal plane of the cradle base.
Figure 14:
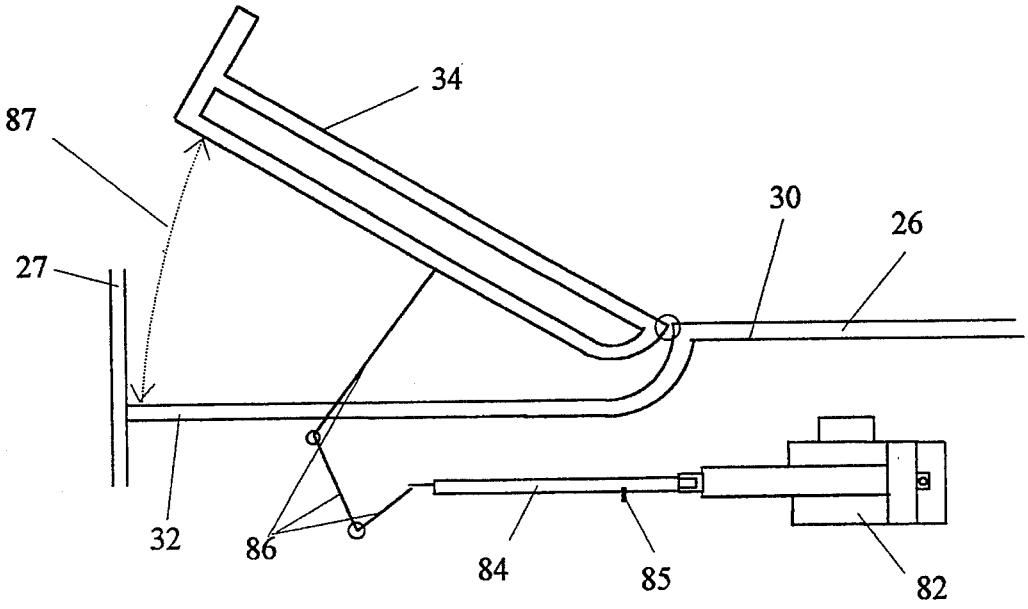

The cradle 11 includes an elongated cradle base 26 which is attached at one end to a vertical head board panel 27. The cradle base 26 is also attached at the opposite end to a vertical foot board panel 29. A bed mattress 28, shown in FIG. 3, is received on top of the cradle base 26 and the cradle head panel 34. The cradle base 26 is divided into a lower cradle portion 30 for receiving the lower body and an upper cradle portion 32. The upper cradle portion 32 includes a cradle head panel 34 for receiving the upper body and patient's head. The cradle head panel 34 is adapted for being raised from and lowered to the top of the upper cradle portion 32, as shown in FIGS. 13 and 14.

Disposed along both sides of the lower cradle portion 30 and the cradle head panel 34 are adjustable side panels 36 which can be raised and lowered as shown in FIGS. 3–6. The side panels 36 include adjustable safety rails 38 which prevent a patient from falling out of the bed.

Figure 2:
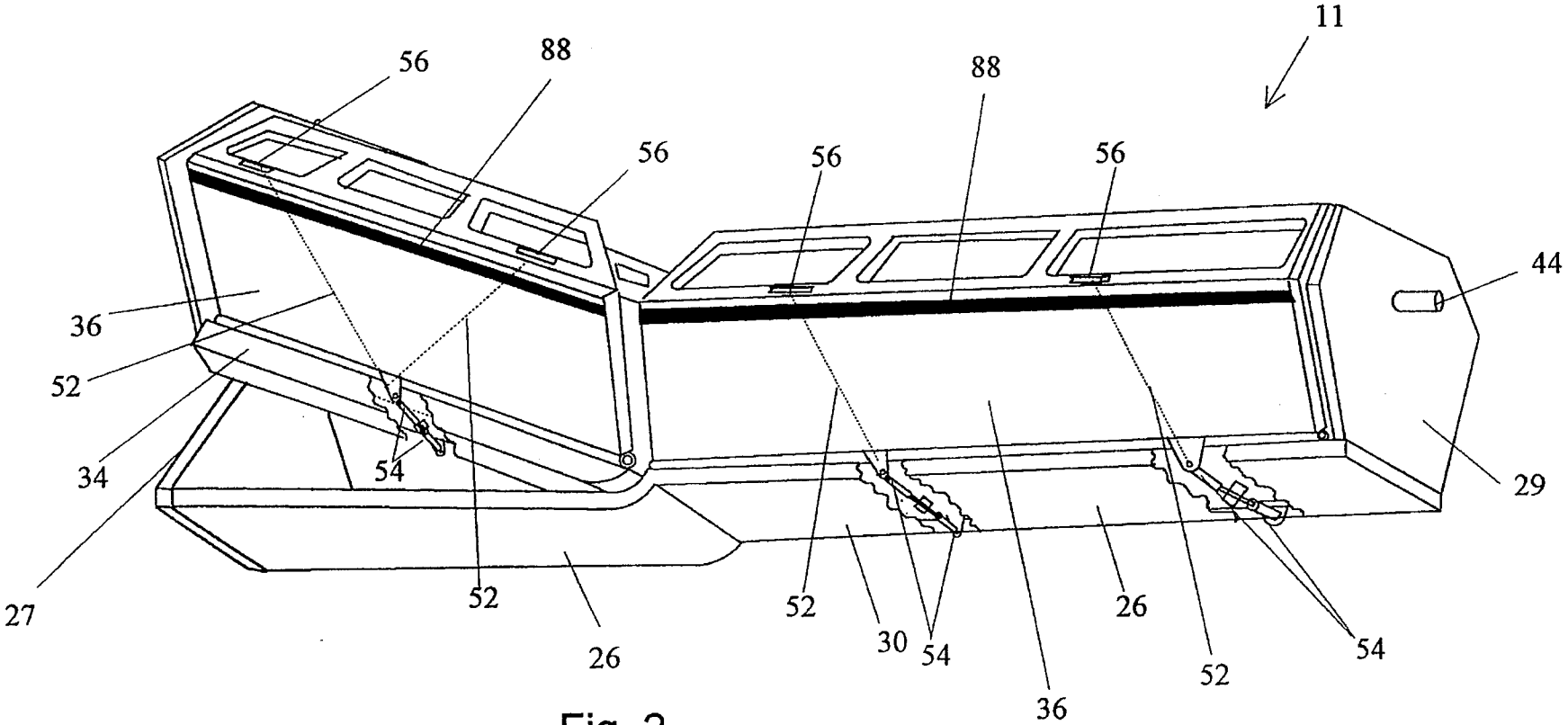
FIG. 2 is a perspective view of a cradle base removed from the oscillatory bed frame with the bed's side panels shown in a raised position.
Figure 8:
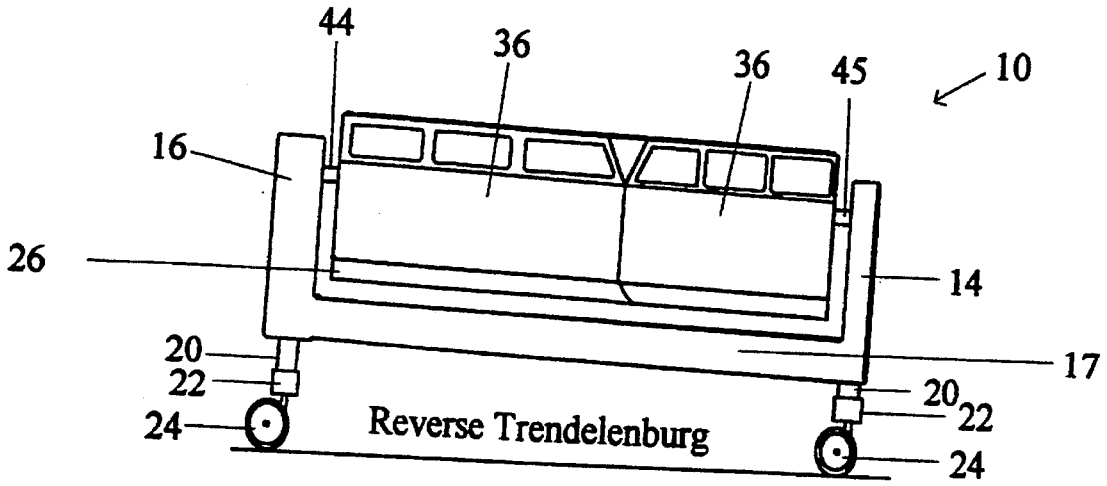
FIGS. 7 and 8 are side views of the oscillating bed portraying the raising of the head board section (FIG. 7) and the foot board section (FIG. 8) to provide a Trendelenburg and Reverse Trendelenburg tilting effect.
Figure 7:
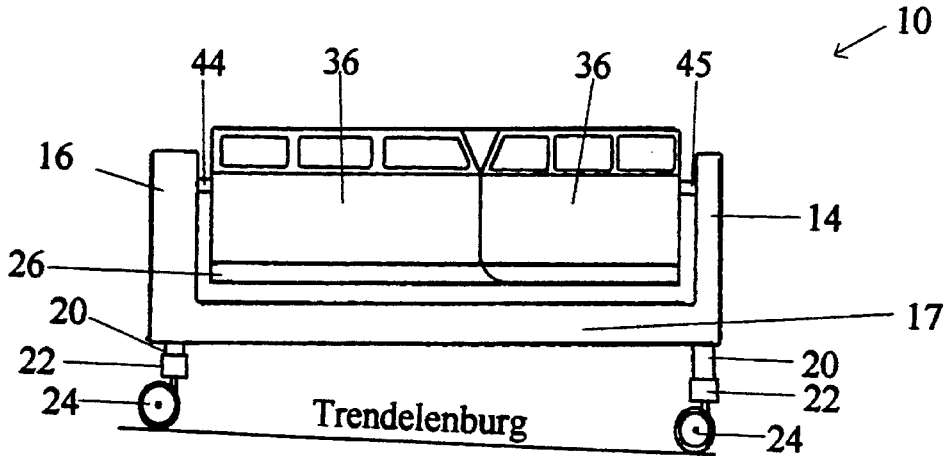

In this view, a portion of the foot board 16 has been cut away to expose a drive wheel 40 and an attached bearing housing 42 used to receive one end of a trunnion 44. The trunnion 44, shown in FIG. 2, is mounted on the vertical foot board panel 29 of the cradle base 26. The cradle base 26 also includes a trunnion 45 mounted on the vertical head board panel 27 for attachment to an idle bearing inside the head board section 14. The second trunnion 45 is shown in FIGS. 7 and 8. The idle bearing is not shown in the drawings. The drive wheel 40 includes a drive belt 46 which is attached to a reduction gear box 48. The gear box 48 is driven by a drive motor 50. The drive gear box 48, drive belt 46, drive motor 50 and drive wheel 40 provide the means for oscillating the subject oscillatory bed cradle 11 in a manner similar to the oscillatory bed as described in U.S. Pat. No. 5,103,511 to Sequin.

A clutch/brake handle 49 can be observed at the inside of the foot board section 16. A similar handle appears on the other side of the foot board section 16, but cannot be seen in FIG. 1. Handle 49 operates a clutch/brake located at the output of the reduction gear box 48. The reduction gear box 48 transmits power from the drive motor 50 to the drive belt 46 and drive wheel 40 which rotate the cradle trunnion 44.

The clutch/brake remains in the engaged position until a care provider depresses the clutch/brake handle 49. Upon releasing the clutch/brake the cradle 11 may manually be rotated to the desired position within the operating arc. The clutch/brake is then re-engaged causing the cradle to remain in the desired position. When the clutch/brake is disengaged the clutch/brake drive belt 46 and drive wheel 40 remain engaged to the trunnion 44, providing sufficient resistance to prevent the cradle 11 from rotating out of control when the position is changed manually. This function would most often be used to reposition the cradle 11 to clean the bed, for examination of the patient or for emergencies that require the patient to be turned to another position.

Figure 4:
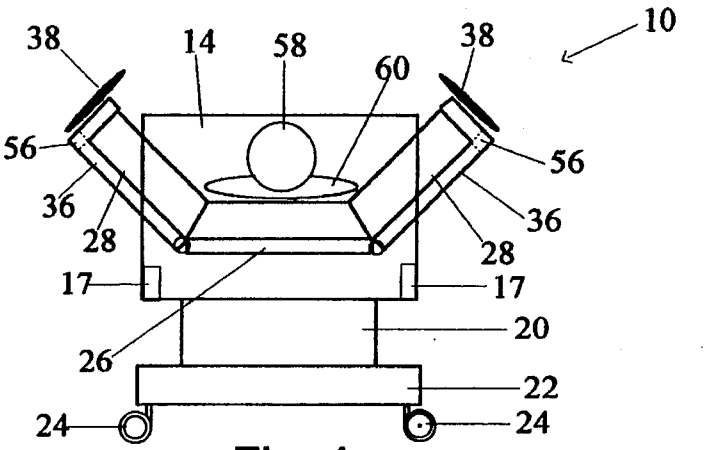
FIGS. 3–6 illustrate a front cross sectional view, taken along lines 3—3 shown in FIG. 1, with the cradle base and side panels in a lowered horizontal position (FIG. 3), with the side panels in a semi-raised position (FIG. 4), with the side panels in a completely raised position (FIG. 5), and the cradle base and side panels in the lowered horizontal position with arrows illustrating the degree of movement of the side panels (FIG. 6).
Figure 6:
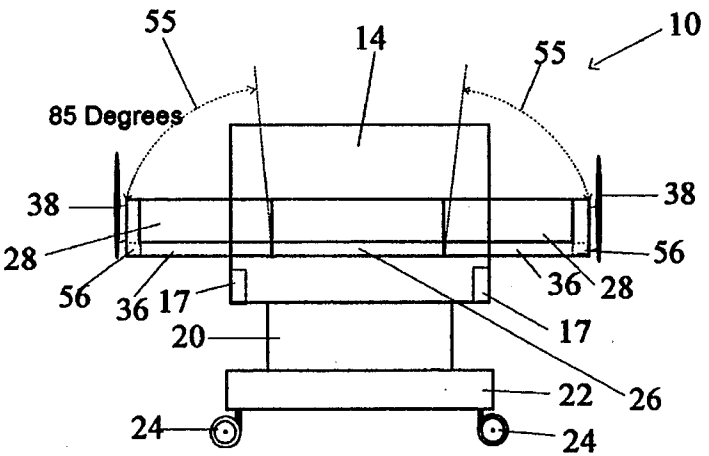
Figure 5:
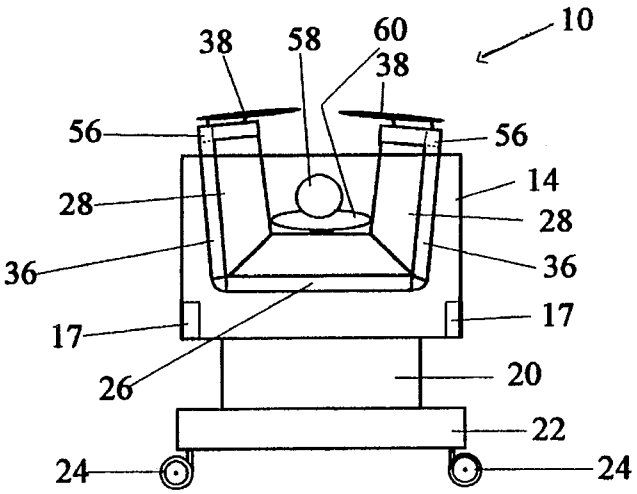

In FIG. 2, a perspective view of the cradle 11 is shown removed from the unitized frame 12. The side panels 36, which are hinged to both sides of the lower cradle portion 30 and the cradle head panel 34 of the cradle base 26, are operated by a cable linkage 52 attached to enclosed gas cylinders 54. The gas cylinders 54 are mounted on the bottom of the lower cradle portion 26 and the cradle head panel 34. The side panels 36 are adjustable to an infinite range of positions from a level or horizontal position shown in a cross sectional front view in FIG. 3 as taken along lines 3—3 shown in FIG. 1, to a position of 45 degrees from the horizontal as shown in FIG. 4, and up to 85 degrees from the horizontal as shown in FIG. 5. Arrows 55 in FIG. 6 illustrate the degree of movement of the side panels 36 from a horizontal or flat position up to 85 degrees above the horizontal.

The side panels 36 are controlled by grasping adjustable side panel releases 56 located on each adjustable side panel 36. The side panel releases 56 are connected by a cable linkage 52 to a valve in each gas cylinder 54. By squeezing both side panel releases 56 on each side panel 36 in unison, the valve in the associated enclosed gas cylinder 54 allows captivated gas to escape through the valve, past an "O" ring retainer, and to the opposite side of the enclosed gas cylinder 54. As long as the side panel releases 56 are squeezed, the valve inside the gas cylinder 54 allows gas to move from one side of the cylinder 54 to the other and the adjustable side panel 36 is free to be moved upward or downward within the arc shown in FIG. 6. Releasing the side panel releases 56 stops the movement of that side panel 36 and holds it in the position attained.

The adjustment range of the side panels 36 allows for a total flattening of the cradle 11 surface for cleaning and emergencies as shown in FIG. 3. By adjusting the side panels 36 upward as shown in FIG. 4 and 5, the patient is retained in a desired position during oscillation thereby restricting sliding movement of the patient's body. The adjustment of the side panels 36 is made to accommodate the patient and provide the most comfortable position for oscillation, based upon patient size and therapeutic needs. Adjustment of these side panels 36 also reduces any shear on the patient's skin that could result from sliding during oscillation.

In FIGS. 3–5 the patient's head is represented by a darkened circle 58 and the patient's body by an ellipse 60. The movement of the adjustable side panels 36 is constrained within the desired arc of 85 degrees by mechanical stops located within the hinges on both ends of each adjustable side panel 36, the gas cylinder 54 operating range stops and the location of the longitudinal member 17 of the unitized frame 12. The hinges and stops are not shown in the drawings.

Figure 9:
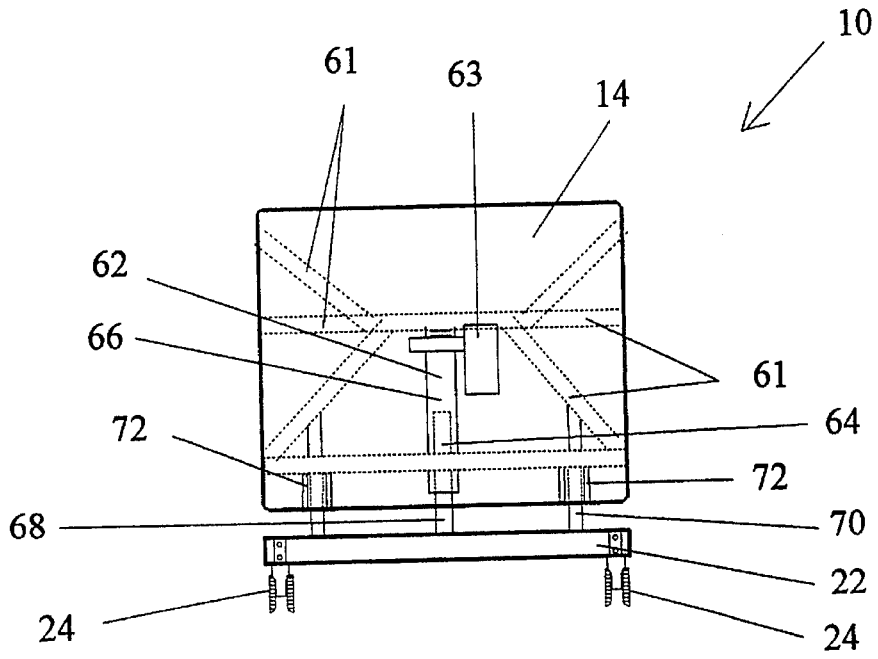
FIGS. 9 and 10 are rear views of the head board section in the raised (FIG. 10) and lowered (FIG. 9) positions with a head board section outside panel removed to expose a linear actuator for raising and lowering the head board section.
Figure 10:
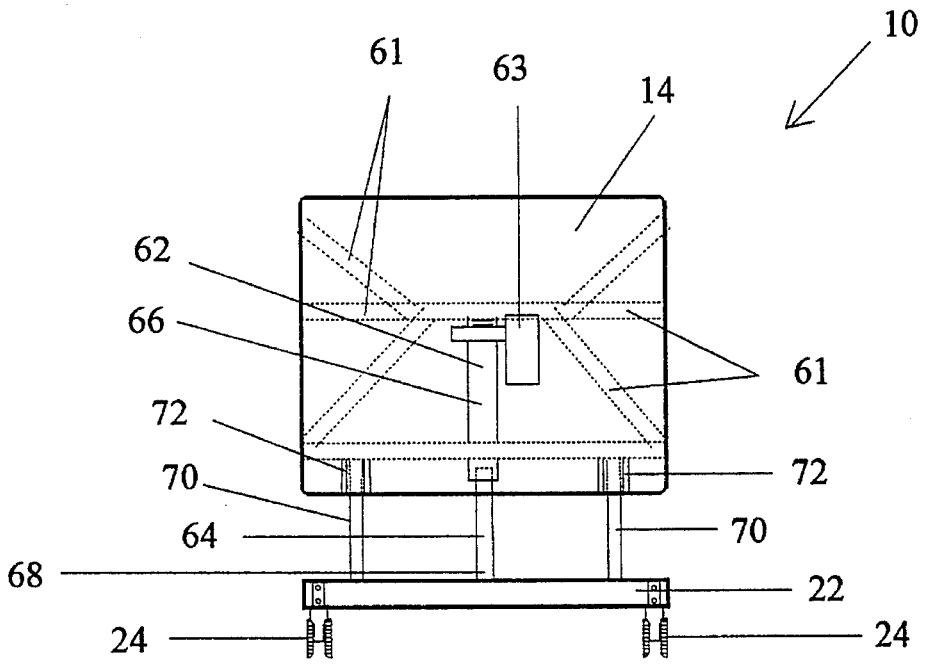

In FIG. 7 lowering the patient's feet relative to his or her head is illustrated. As mentioned above, this is called the Trendelenburg position. In FIG. 8 the lowering of the patient's head relative to his or her feet is illustrated. This position is called the reverse Trendelenburg. These positions are achieved by operating a linear actuator to move the adjustable support assembly 20 in the head board section 14 and the foot board section 16 into or out of the unitized frame 12. The raising and lowering of the head board section 14 is illustrated in FIGS. 9–10. The raising and lowering of the foot board section 16 is accomplished in a similar manner.

In FIGS. 9 and 10 the outside panel has been removed from the back of the head board section 14 to exposed a head board frame 61 with a linear actuator 62 mounted on a portion of the frame 61. The linear actuator 62 includes a drive motor 63 which drives a linear screw 64. The linear screw 64 is raised and lowered inside a screw housing 66 by the drive motor 63. An end 68 of the screw 64 is releasably attached to the top of the caster wheel assembly 22.

The adjustable support assembly 20 as mentioned above includes a cover 21. In FIGS. 9 and 10, the cover 21 has been removed to expose the lower portion of the linear screw 64 and a pair of guide rods 70. The guide rods 70 are releasably attached to the top of the caster wheel assembly 22 and extend upwardly through guide rod sleeves 72 mounted on the bottom of the frame 61. The guide rods 70 and sleeves 72 hold the adjustable support assembly 20 in alignment with the head board section 14 and foot board section 16. In FIG. 9 the drive motor 63 has been actuated and the linear screw 64 raised into the screw housing 66. In this figure, the head board section 14 has been lowered so that the foot board section 16 can be raised to provide a reverse Trendelenburg position as shown in FIG. 8. In FIG. 10, the drive motor 63 has been actuated and the linear screw 64 extended downwardly from the screw housing 66. In this example, the head board section 14 has been raised and the footboard section 16 lowered to provide a Trendelenburg position as shown in FIG. 7.

Figure 15:
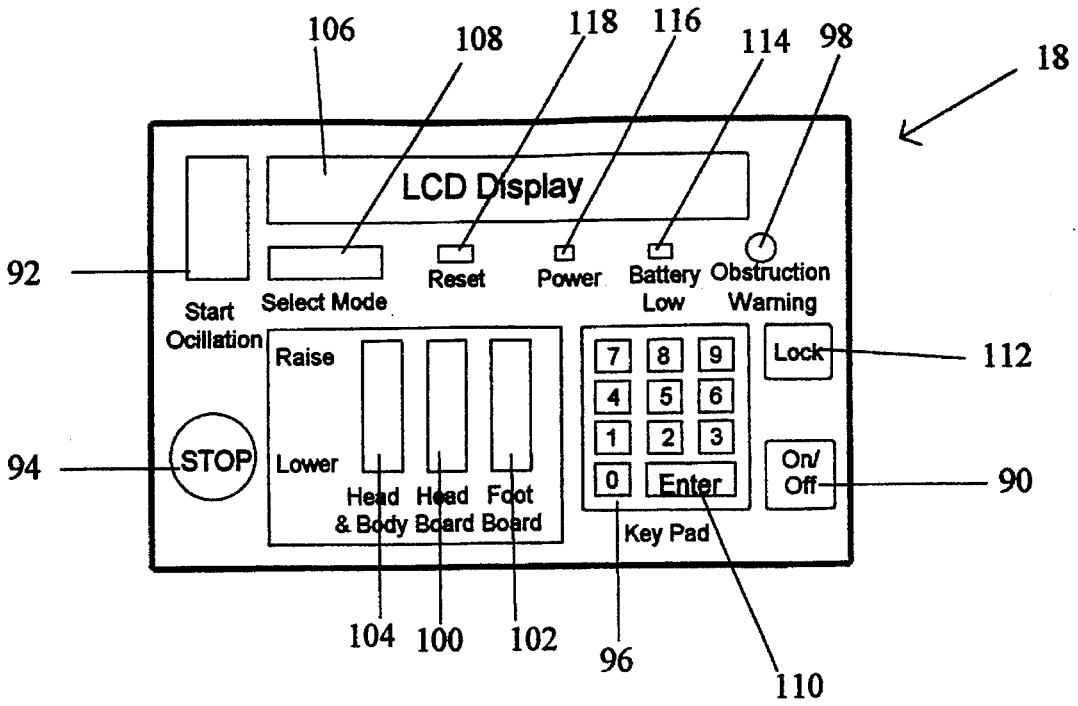
FIG. 15 illustrates a front view of the control panel mounted on the outside of the foot board section.

It should be noted that each of these adjustable support assemblies 20 can move vertically a total of approximately 8" thereby producing a maximum bed 10 tilt in the desired direction of approximately 6 degrees. Control of the linear actuators 62 is accomplished by depressing a head board raise/lower switch 100 or a foot board raise/lower switch 102 located in the control panel 18 found on the outside of the foot board section 16, as shown in FIGS. 1 and 15. Also it should be mentioned that while the linear actuator 62 is shown mounted inside the head board section 14, it can be appreciated that there are a variety of other types of mechanisms that can be used equally well in stabilizing raising and lowering the head board section 14 and foot board section 16 without departing the spirit and scope of the invention as described herein.

Figure 11:
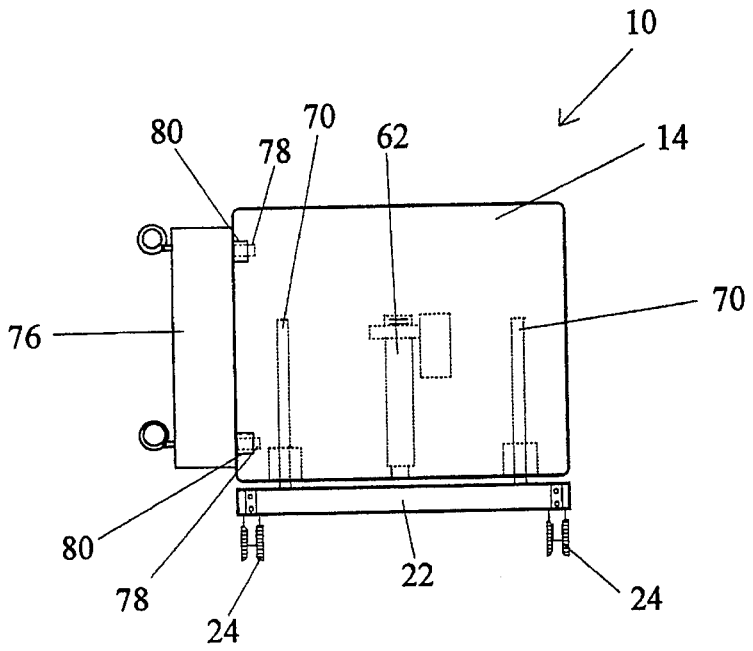
FIGS. 11 and 12 illustrate rear views of the head board section with the oscillating bed fully lowered and a dolly attached to the left side (FIG. 11); rotated 90 degrees and mounted on the transport dolly, with the castor assembly removed, for moving the bed through a narrow doorway (FIG. 12).
Figure 12:
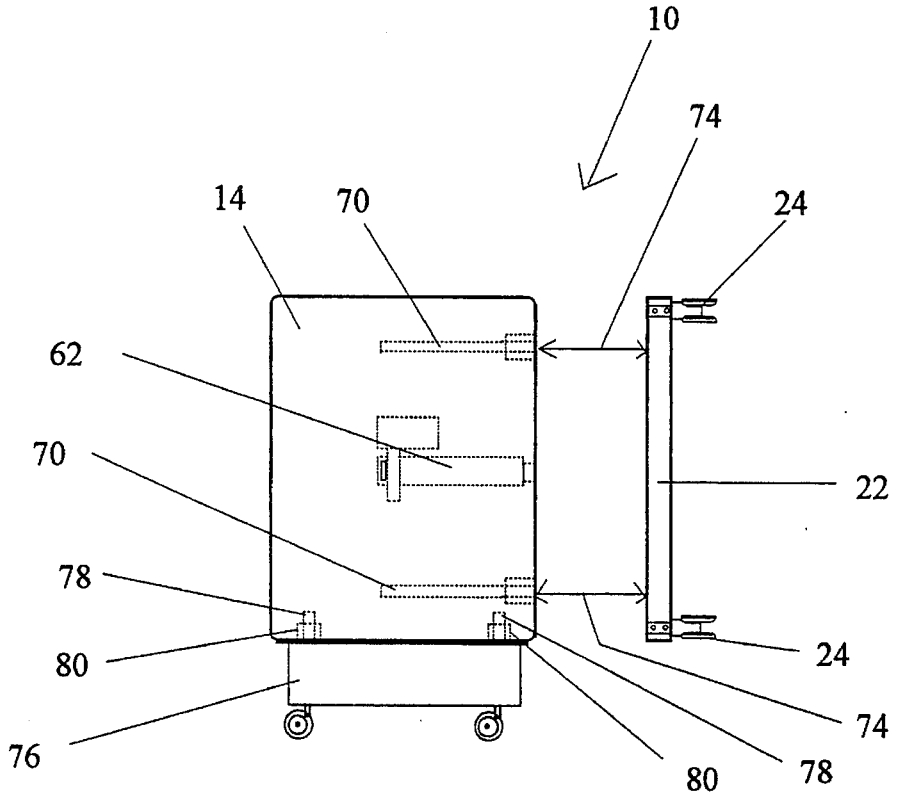

In FIG. 11 a rear view of the head board section 14 is shown with the bed transport dolly 76 attached by connecting pins 78 inserted into transport sleeves 80. Both the head board section 14 and the foot board section 16 have built-in transport sleeves 80 to accommodate the connecting pins 78. After mounting the transport dolly 76 on both the head board section 14 and the foot board section 16, the entire oscillatory bed 10 has been lowered to its lowest position by actuating the linear actuator 62 in the head board section 14 and the foot board section 16 by operating the head board raise/lower switch 100 and the foot board raise/lower switch 102 located on the control panel 18. The entire oscillatory bed 10 can now be picked up, rotated 90 degrees and lowered onto the transport dolly 76 wheels as shown in FIG. 12. The castor wheel assemblies 22 are now released from the linear actuator 62 and the guide rods 70 at both the head board section 14 and the foot board section 16 as indicated by the arrows 74 in FIG. 12. The width of the rotated oscillatory bed is now 30 inch and it can now be moved through a standard 32 inch doorway.

As shown in FIGS. 13 and 14, the patient's head and upper body can be lowered and raised for comfort and/or therapy by moving the cradle head 34 which is hinged to the lower cradle portion 30 of the cradle base 26. In FIG. 13, the cradle head panel 34 shown in a lowered horizontal position on top of the upper cradle portion 32 of the cradle base 26. Mounted to the bottom of the cradle base 26 is a linear actuator 82. The linear actuator 82 is connected to a gas cylinder 84 which in turn is connected to linkage 86. The linkage 86 is attached to the bottom of the cradle head panel 34 for raising the head panel 34 up to 30 degrees above the plane of the cradle base 26 as indicated by arrow 87 shown in FIG. 14. This raised position of the patient's head and upper body is known as a semi-Fowlers position.

Figure 17:
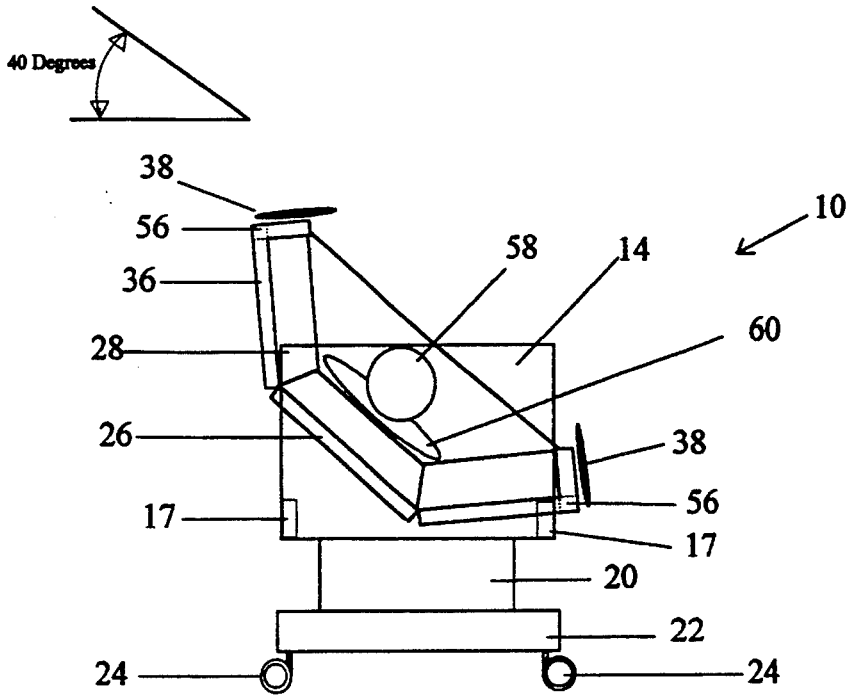
Figure 18:
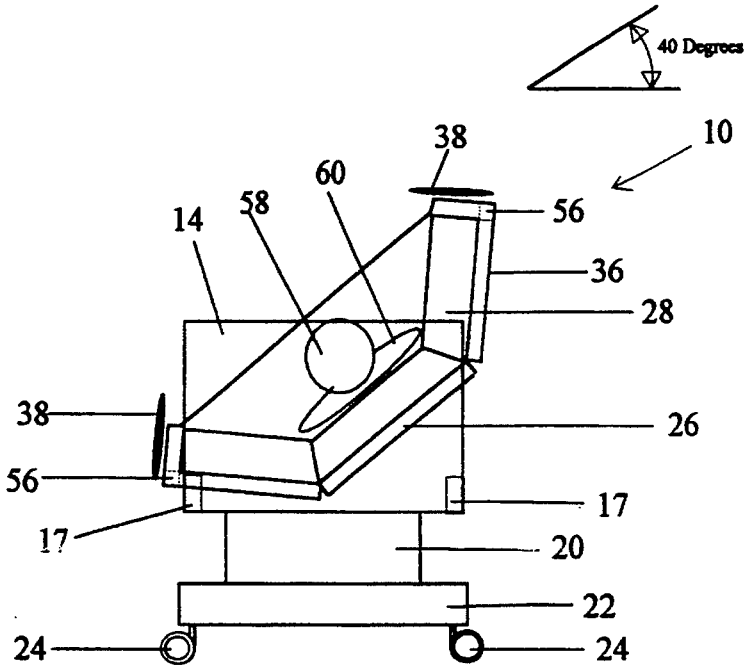

Lowering and raising the cradle head panel 34 is accomplished by the use of the linear actuator 82 and is controlled by a switch located on the control panel 18 attached to the foot board section 16. Also, it may be operated by the patient, if desired, via the optional portable remote control 19 which can be located on the bed 10 and near the patient. The gas cylinder 84 is used in conjunction with the linear actuator 82 in case of electrical source loss or electrical failure of the actuator 82. For example, if the cradle head panel 34 is in a raised position as shown in FIG. 14 and the actuator 82 fails to lower the panel 34, the cradle head panel 34 can be lowered manually by operating the gas cylinder 84 using the gas cylinder lever 85. This action will lower the cradle head panel 34. When the head and upper body of the patient are moved from the horizontal position by the raising of the cradle head panel 34 with the linear actuator 82, the oscillation of the oscillatory bed 10 will automatically be reduced from a maximum of plus or minus 40 degrees as shown in FIGS. 17 and 18 to a maximum of plus or minus 20 degrees.

Referring to FIG. 15, a front view of the control panel 18 located on the outside of the foot board section 16 is shown. An on/off switch 90 is provided to supply the electrical power to the control panel 18 and through it power to the drive motor 50, the linear actuators 62 and 82, and the microprocessor that controls the various functions of the oscillatory bed 10. A power on indicator light 116 is provided, which is illuminated when the on/off switch 90 is on.

A microprocessor is incorporated into the control panel 18. This is programmable by the care provider through the keypad 96 and the various keys located on the control panel 18. Immediately upon activating the electrical power, the care giver will automatically be prompted to "select mode" on the LCD display 106 if no programming exists in the microprocessor's memory. The care provider must select one of the following modes based on the therapy prescribed by a medical professional.

CONTINUOUS MODE—the bed will oscillate in an 80 degree arc (40 degrees from horizontal in either direction), completing a 160 degree full cycle at various speeds ranging from 30 minutes to 240 minutes.

Figure 16:
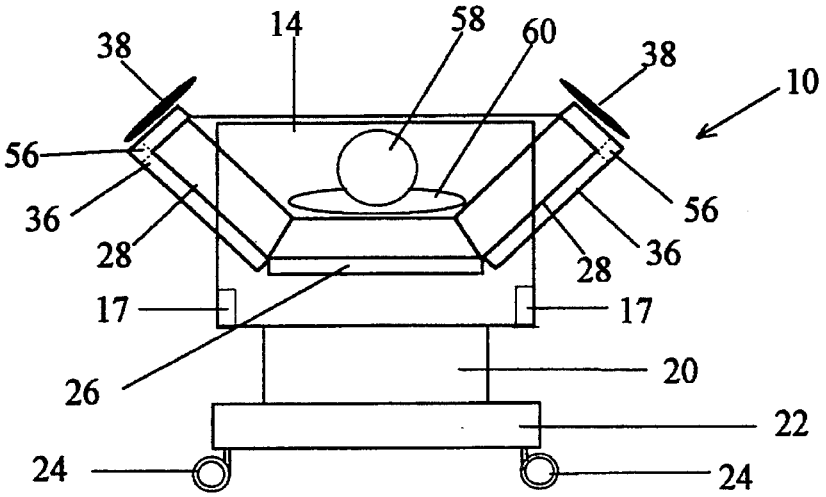
FIGS. 16–18 show front cross sectional views, taken along lines 3—3 shown in FIG. 1, of the rotation of the oscillating bed from a horizontal position (FIG. 16), to an extreme left raised position (FIG. 17), and moving from left to right to an extreme right raised position (FIG. 18).

INTERVAL MODE—the bed may be programmed to oscillate and stop at three positions; the right side (FIG. 17), the back or horizontal (FIG. 16), and the left side (FIG. 18). The stop times at each of these positions is variable and periods ranging form 5 minutes to 120 minutes may be selected by the care giver.

Display of these two options automatically alternate on the LCD display 106 each time the select mode key 108 is depressed. To select the alternate mode the care giver must again depress the select mode key 108. Upon releasing the select mode key 108, whichever mode is currently displayed on the LCD display 106 is selected by depressing the enter key 110.

Next the care provider will be prompted to input the oscillation or stop times depending upon the mode selected. The times are entered, in minutes, through the keyboard 96 and by depressing the enter key 110. Each required entry is automatically prompted in the LCD display 106 dependent on the mode selected. When all required entries are completed, programmed selections may now be locked into the microprocessor memory by depressing the lock key 112 and a user code prompted. This code may be entered if desired, to prevent unauthorized changes in the programming by entering up to 4 digets in the key pad 96 and depressing the enter key 110. The selections are retained in the microprocessor memory until changed by the care giver. A battery backup will maintain these selections in the microprocessor for a period of 48 hours (if the rechargeable battery is fully charged) even when the electrical power if turned off. An automatic battery charger is incorporated in the control panel 18 assembly. A battery low indicator light 114 is located on the front of the control panel 18 should the battery charge be lower than a specified charge level. The rotation of the cradle 11 of the oscillatory bed 10 may now be started by depressing the start oscillation key 92. The oscillation will continue until stopped by depressing the stop key 94, or by the cradle 11 encountering an obstruction as described below.

Further, the bed oscillation is halted upon contact with an obstruction through the use of pressure sensitive strips 88 located on the exterior edges of the side panels 36. The pressure sensitive strips 88 are shown in FIG. 2. Upon contact with any obstruction or any applied mechanical pressure to any location on any of the pressure sensitive strips 88, the oscillation of the cradle 11 automatically stops, an audible tone is sounded for approximately one minute and a flashing obstruction light 98 on the control panel is illuminated and begins flashing. The cradle 11 will remain stopped and the obstruction light 98 will continue flashing until the obstruction is removed and the microprocessor reset by depressing the reset key 118.

To raise or lower the head board section 14, a head board raise/lower switch 100 on the control panel 18 is pushed up to raise and pushed down to lower. The terms "Raise" and "Lower" are plainly shown on the control panel 18 as a guide to operating the switches 100, 102 and 104. A foot board switch 102 on the control panel 18 operates in the same manner as the head board switch 100 to raise and lower the foot board section 16. As mentioned above, the raising of either the head board section 14 or the foot board section 16 provide the means for obtaining Trendelenburg or reverse Trendelenburg positions of the bed 10 as shown in FIGS. 7 and FIG. 8. The degree of the tilt for each of these positions may be increased by raising one end of the oscillatory bed 10 and lowering the other. Also, by completely lowering both the head board section 14 and foot board section 16 easier access for disabled or elderly patients is provided. In the fully lowered position of the oscillatory bed 10, the top of the mattress 28 is approximately 30 inches from the floor. Further, in the lowered position, the caster wheel assemblies 22 can be removed from the head board section 14 and foot board section 16 after the bed 10 has been turned 90 degrees for transporting on the transport dollies 76 as described in the discussions of FIGS. 11 and 12.

The control panel 18 also includes a head and body switch 104 for raising and lowering the cradle head panel 34. This function may also be activated by the patient, if desired, by using the remote control 19. It should be noted that at any time the cradle head panel 34 is raised above the horizontal or level position, the oscillation of the oscillatory bed 10 will automatically be reduced to one-half the normal range.

While the invention has been particularly shown, described in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An oscillatory bed with mattress for receiving a patient's lower body, upper body, and head thereon, the oscillatory bed comprising:

a unitized bed frame having a head board section at one end of said frame and a foot board section at an opposite end of said frame, and the two longitudinal members joining these two sections;

an elongated cradle base having a cradle base axis centered on and along the length of said cradle base, said cradle base having a first end, a second end, and opposite sides, the first end rotatably mounted on said head board section, the second end rotatably mounted on said foot board section, said cradle base divided into an upper pivotally mounted cradle portion with a cradle head panel and a lower cradle portion;

means for pivotally raising and lowering said cradle head panel above said upper cradle portion;

a pair of first side panels pivotally mounted on opposite sides of said cradle head panel and a pair of second side panels pivotally mounted on opposite sides of said lower cradle portion, said pair of first and second side panels selectively pivotable in a range up to 85 degrees above the plane of the head panel and the plane of the lower cradle portion respectively to form a U-shaped cross sectional configuration; and oscillating means connected to said cradle base for oscillating said cradle base about the cradle base axis, said cradle base oscillated independently from said bed frame.

2. The oscillatory bed as described in claim 1 further including means for raising and lowering said pair of first and second side panels on the opposite sides of said cradle head panel and said lower cradle portion, said means for raising and lowering mounted on said cradle base including said head panel and connected to said pair of first and second side panels.

3. The oscillatory bed as described in claim 1 further including means for raising and lowering said head board section connected to said head board section and means for raising and lowering said foot board section connected to said foot board section.

4. The oscillatory bed as described in claim 1 further including an electrical control panel mounted on said frame and connected to said cradle base with means for controlling the oscillation of said cradle base in a continuous mode and in a mode with interval stops during the oscillations.

5. An oscillatory bed with mattress for receiving a patient's lower body, upper body, and head thereon, the oscillatory bed comprising:

a unitized bed frame having a head board section at one end of said frame and a foot board section at an opposite end of said frame, and the two longitudinal members joining these two sections;

an elongated cradle base having a cradle base axis centered on and along the length of said cradle base, said cradle base having a first end, a second end, and opposite sides, the first end rotatably mounted on said head board section, the second end rotatably mounted on said foot board section, said cradle base divided into an upper pivotally mounted cradle portion with a cradle head panel and a lower cradle portion;

means for pivotally raising and lowering said cradle head panel above said upper cradle portion;

a pair of first side panels pivotly mounted on opposite sides of said cradle head panel and a pair of second side panels pivotly mounted on opposite sides of said lower cradle portion, said pair of first and second side panels selectively pivotable in a range up to 85 degrees above the plane of the head panel and the plane of the lower cradle portion respectively to form a U-shaped cross sectional configuration;

gas cylinders mounted on said cradle base including said head panel and having cable linkage connected to said pair of first and second side panels, said gas cylinders and cable linkage used for raising and lowering each of said pair of first and second side panels individually; and oscillating means connected to said cradle base for oscillating said cradle base about the cradle base axis, said cradle base oscillated independently from said bed frame.

6. The oscillatory bed as described in claim 5 wherein said cradle head panel is adapted for raising above said upper cradle portion in a range of up to 30 degrees above the plane of said cradle base.

7. The oscillatory bed as described in claim 5 further including a linear actuator mounted on said cradle base and having linkage connected to said cradle head panel whereby when said linear actuator is activated said linear actuator and linkage will raise said cradle head panel upwardly in a range of up to 30 degrees above the upper base portion of said cradle base and in a semi-Fowlers position.

8. The oscillatory bed as described in claim 5 further including a linear actuator mounted in said head board section, whereby when said linear actuator is activated said head board section is raised and the patient's head and upper body are raised above the height of the patient's feet and lower body in a Trendelenburg position.

9. The oscillatory bed as described in claim 5 further including a linear actuator mounted in said foot board section, whereby when said linear actuator is activated said foot board section is raised and the patient's feet and lower body are raised above the height of the patient's head and upper body in a reverse Trendelenburg position.

10. The oscillatory bed as described in claim 5 further including an electrical control panel mounted on said frame and connected to said oscillating means for controlling the oscillation of said cradle base in a continuous mode with cycle times between 30 and 240 minutes and in a mode with interval stops of 5 to 120 minutes before resuming the oscillations.

11. The oscillatory bed as described in claim 5 further including transport dollies for releasable attachment to one side of said head board section and one side of said foot board section when said unitized bed frame is rotated 90 degrees from the horizontal onto it's side, whereby said transport dollies are used for transporting said oscillatory bed through a doorway or other passageway.

12. The oscillatory bed as described in claim 5 wherein the width of said oscillatory bed when said unitized bed frame is turned on it's side is in a range of 30 inches or less for transporting said oscillatory bed through narrow openings.

13. An oscillatory bed with mattress for receiving a patient's lower body, upper body, and head thereon, the oscillatory bed comprising:

a unitized bed frame having a head board section at one end of said frame and a foot board section at an opposite end of said frame, and the two longitudinal members joining these two sections;

an elongated cradle base having a cradle base axis centered on and along the length of said cradle base, said cradle base having a first end, a second end, and opposite sides, the first end rotatably mounted on said head board section, the second end rotatably mounted on said foot board section, said cradle base divided into an upper pivotally mounted cradle portion with a cradle head panel and a lower cradle portion;

means for pivotally raising and lowering said cradle head panel above said upper cradle portion;

a pair of first side panels pivotally mounted on opposite sides of said cradle head panel and a pair of second side panels pivotally mounted on opposite sides of said lower cradle portion, said pair of first and second side panels selectively pivotable in a range up to 85 degrees above the plane of the head panel and the plane of the lower cradle portion respectively to form a U-shaped cross sectional configuration;

oscillating means connected to said cradle base for oscillating said cradle base about the cradle base axis, said cradle base oscillated independently from said bed frame; and a microprocessor control panel mounted on said frame and connected to said oscillating means, said control panel including means for controlling the oscillation of said cradle base in a continuous mode and with interval stops before resuming the oscillations.

14. The oscillatory bed as described in claim 13 wherein said microprocessor control panel can be programmed wherein oscillations are 30 to 240 minutes per cycle.

15. The oscillatory bed as described in claim 13 wherein said microprocessor control panel can be programmed wherein interval stops are from 5 to 120 minutes before oscillations are resumed.

16. The oscillatory bed as described in claim 15 wherein the interval stops occur when said cradle base is in a horizontal position or in a raised left position or in a raised right position.

17. The oscillatory bed as described in claim 13 wherein said cradle base can be oscillated from a horizontal position to a raised left position in a range of up to 40 degrees above the horizontal and to a raised right position in a range of up to 40 degrees from the horizontal.

* * * * *